US005964598A

United States Patent [19]

Gonzales

[11] Patent Number: 5,964,598

[45] Date of Patent: Oct. 12, 1999

[54] ELECTRICAL APPARATUS LOCKOUT DEVICE

[75] Inventor: Rick Gonzales, Chesapeake, Va.

[73] Assignee: Southeastern Universities Research Assn., Newport News, Va.

[21] Appl. No.: 09/061,478

[22] Filed: Apr. 16, 1998

[51] Int. Cl.[6] ..... H01R 13/44

[52] U.S. Cl. ..... 439/133; 439/148; 439/364

[58] Field of Search ..... 439/133, 148, 439/364, 304, 149

[56] References Cited

U.S. PATENT DOCUMENTS 3,182,280 5/1965 Etal ..... 439/66
4,932,874 6/1990 Hollopeter ..... 439/304

*Primary Examiner*—Neil Abrams
*Assistant Examiner*—J. F. Duverne

[57] ABSTRACT

A simple lockout device for electrical equipment equipped with recessed power blades is described. The device comprises a face-plate (12) having a threaded member (14) attached thereto and apertures suitable for accommodating the power blades of a piece of electrical equipment, an elastomeric nose (16) abutting the face-plate having a hole for passage of the threaded member therethrough and power blade apertures in registration with those of the face-plate, a block (20) having a recess (34) in its forward face for receiving at least a portion of the hose, a hole therein for receiving the threaded member and an integral extension (26) extending from its rear face. A thumb screw (22) suitable for turning with the hands and having internal threads suitable for engaging the threaded member attached to the face-plate is inserted into a passage in the integral extension to engage the threaded member in such a fashion that when the device is inserted over the recessed power blades of a piece of electrical equipment and the thumb screw (22) tightened, the elastomeric nose (16) is compressed between the face-plate (12) and the block (20) forcing it to expand laterally thereby securing the device in the recess and precluding the accidental or intentional energization of the piece of equipment by attachment of a power cord to the recessed power blades. Means are provided in the interval extension and the thumb screw for the attachment of a locking device (46) which will satisfy OSHA standards.

7 Claims, 5 Drawing Sheets

ELECTRICAL APPARATUS LOCKOUT DEVICE

The United States may have certain rights to this invention, under Management and Operating Contract DE-AC05-84ER from the United States Department of Energy.

FIELD OF THE INVENTION

The present invention relates to a device for preventing the unauthorized use of an electrical device during a lockout situation.

Background of the Invention

The Occupational Safety and Health Administration Regulations 29 C.F.R. part 1910, Oct. 31, 1989 require employers to establish a program and to utilize procedures for affixing appropriate use prevention, or "lockout" devices on electrical equipment undergoing maintenance or servicing. The lockout device serves to prevent the unauthorized or accidental operation, energization or start-up of the equipment while it is in place. The lockout device must be removed or disabled before operation of the electrical equipment can occur.

Because of these regulations, a large number of devices have been developed to prevent the accidental energization of electrical equipment while it is undergoing maintenance or servicing. A major class of such devices is designed to prevent connection of the power plug of the electrical equipment to an energy source. Typically, lockout devices of this type are designed to interact with the power blades of the power plug which forms part of the power cord. Such devices when secured to the plug prevent the insertion of the plug into a power outlet, thus precluding accidental energization of the equipment. Lockout devices of this type are disclosed in U.S. Pat. Nos. 3,543,544(Efston), 2,654,073 (Katz), 4,025,140 (Matys), 4,445,738 (Wiencke), 4,566,297 (Hawley), 2,664,734 (McEneaney), 2,733,416 (Evalt) and 5,176,527 (Herbert).

Lockout devices as exemplified by the above mentioned patents usually include a body, or block, having a passage formed therein which accepts one or more blades of the electrical plug. A gripping arrangement which either acts against a surface of one or more of the blades and/or engages a feature such as an opening therein or thereon is disposed within the block. Such devices generally include a lock and key arrangement which complies with the OSHA regulations. Such devices are generally relatively mechanically complex, expensive to manufacture and are often bulky or difficult to use.

The device of the present invention is, on the other hand, specifically designed for use with electrical connectors of the type now currently found on most computers and similar types of electrical equipment wherein the male power blades are recessed into the electrical equipment or hardware itself, and the power cord contains a female adapter or socket, which inserts into the recess to enable the socket to engage the power blades. The device of the present invention is lockable to meet OSHA requirements, simple to use, simple in its mechanical design and inexpensive to manufacture.

Summary of the Invention

The present invention relates to an improved device to prevent the unauthorized activation of electrical equipment whose male power connection blades are recessed into the hardware or equipment itself in such a fashion as to engage a female socket when the female socket is inserted into the recess containing the male power connection blades.

DESCRIPTION OF THE DRAWINGS

The invention will be more fully understood from the following detailed description taken in connection with the accompanying drawings, which form a part of this application and in which.

DETAILED DESCRIPTION OF THE INVENTION

Figure 1:
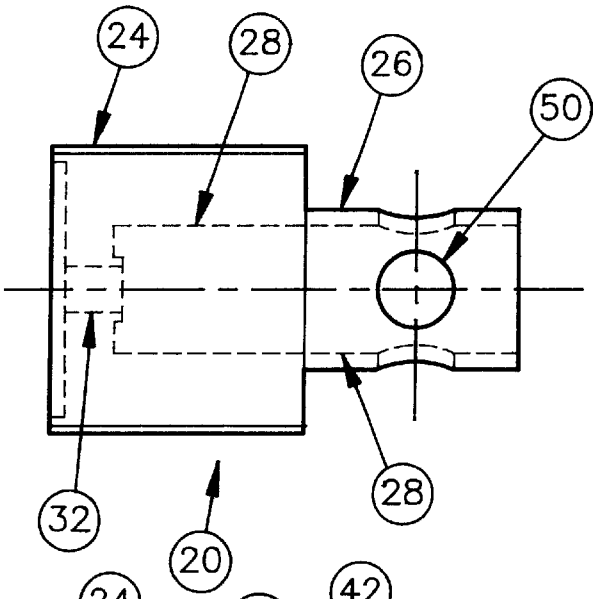
FIG. 1 is a partially phantom top plan view of the block member of the lockout device of the present invention.
Figure 2:
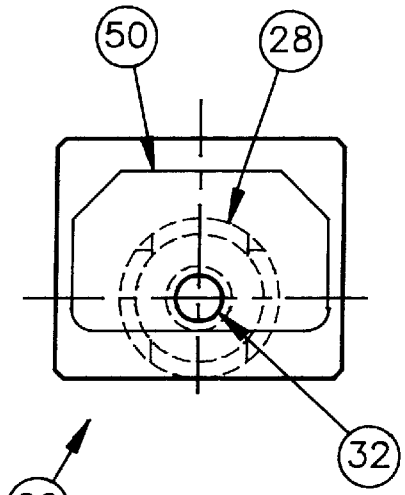
FIG. 2 is a partially phantom front-end view of the block member of the lockout device of the present invention.
Figure 3:
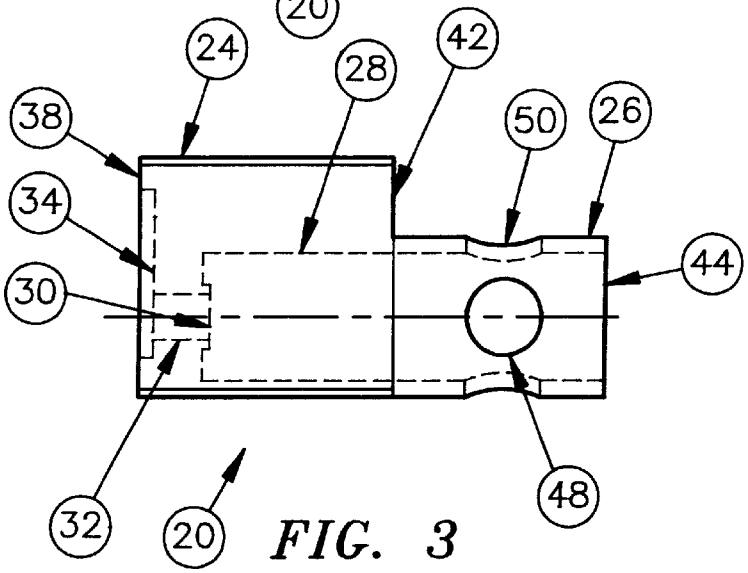
FIG. 3 is a partially phantom side view of the block member of the lockout device of the present invention.
Figure 4:
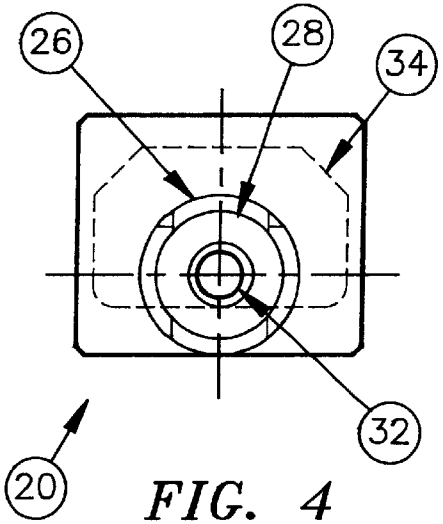
FIG. 4 is a partially phantom rear-end view of the block member of the lockout device of the present invention.

Throughout the following detailed description, similar reference numerals refer to similar elements in all Figures of the drawings.

Figure 8:
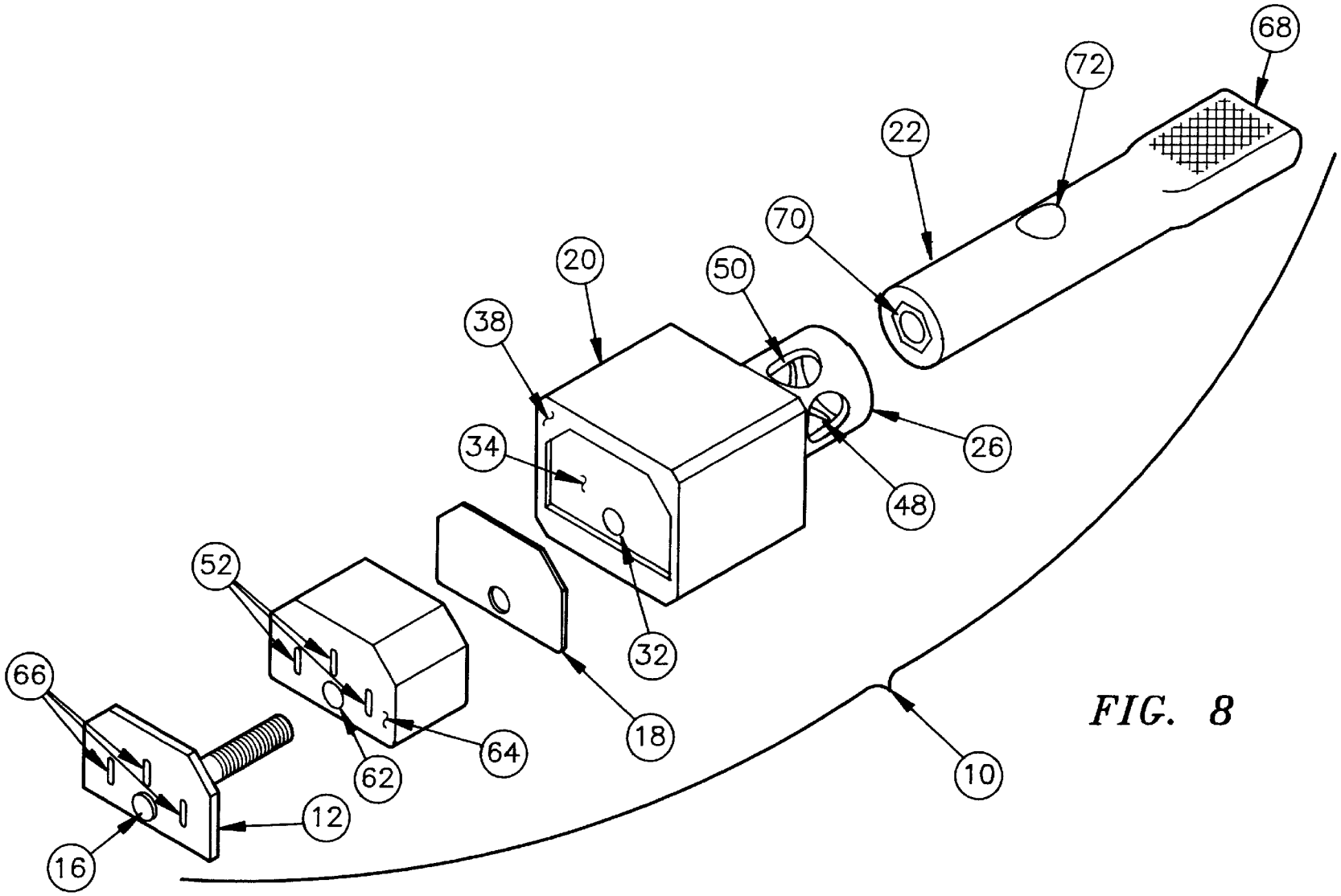
FIG. 8 is an exploded perspective view showing all members and elements of the lockout device of the present invention.

As shown in FIG. 8, the lockout device 10 of the present invention comprises: a face-plate 12, having a threaded member 14 attached thereto or inserted therethrough, a nose member 16, an optional adhesive layer 18, a block 20 and a thumb screw assembly 22 which is internally threaded to engage threaded member 14. Each of the elements of the lockout device of the present invention will now be described in greater detail.

Figure 6:
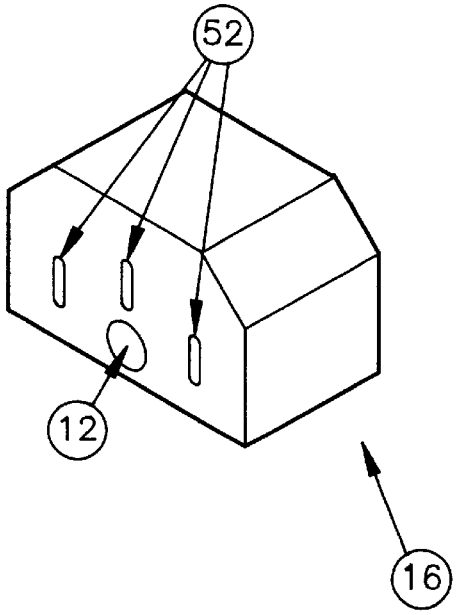
FIG. 6 is a perspective view of the nose member of the lockout device of the present invention.
Figure 7:
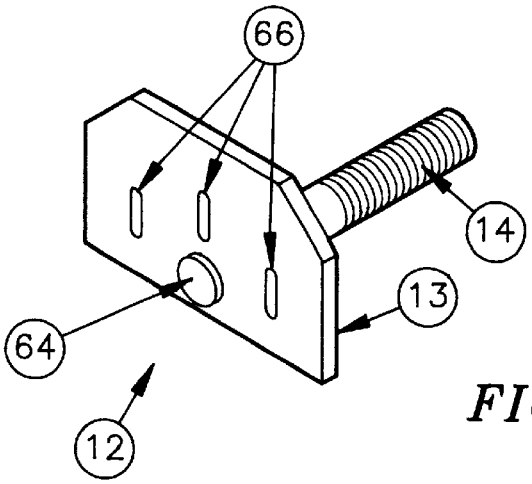
FIG. 7 is a perspective view of the face-plate of the lockout device of the present invention with a threaded member extending rearward therefrom.

As shown in FIGS. 1–4 and 8, block 20, formed, molded or machined from a rigid plastic such as PVC or similar material or machined out of metal, consists of principal member 24 having integral extension 26 extending rearward therefrom. Both principal member 24 and integral extension 26 of block 20 have a cylindrical passage 28 therein for receiving thumbscrew assembly 22 as will be described more fully below. In the case of integral extension 26, cylindrical passage 28 passes completely therethrough while, in the case of principal member 24 cylindrical passage 28 passes only part of the way therethrough terminating at stop 30 where passage 28 meets connecting hole 32 which extends to the opposite face of principal member 24 from integral extension 26. At the point where connecting hole 32 exits principal member 24, a recess 34 of the same general shape and size as nose face 64 shown in FIG. 6 is formed in front face 38 of principal block member 24. As depicted in FIGS. 1–4 connecting hole 32 terminates in recess 34 for the receipt of threaded member 14.

Figure 10:
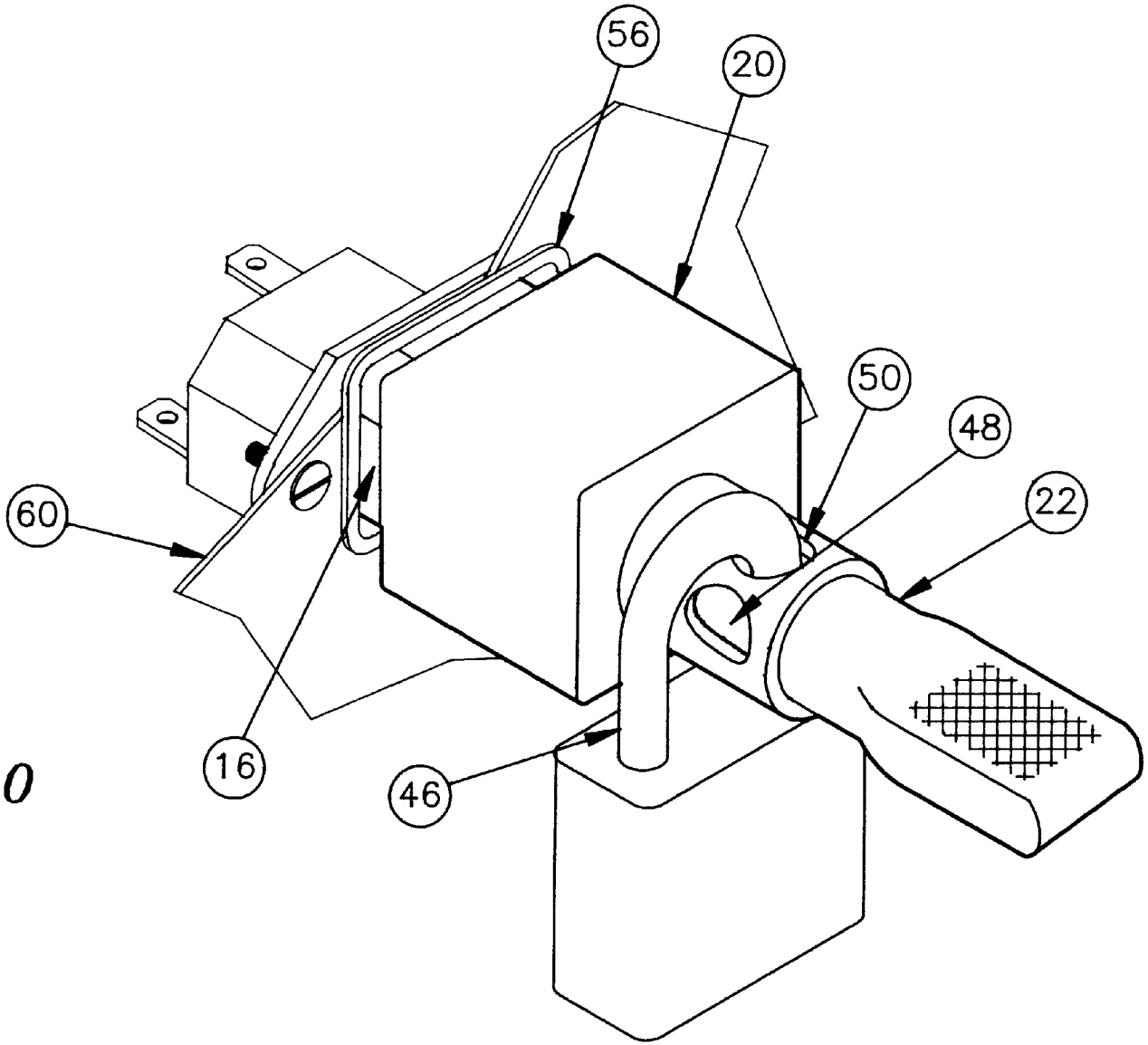
FIG. 10 is a perspective view of the lockout device of the present invention in the installed position with a locking or security cable in place.

Integral extension 26 of block 20 extends from rear face 42 of block 20, and includes or contains the extension of passage 28 which terminates in open end 44 of integral extension 26. As depicted in the various Figures, integral extension 26 is preferably round as this permits easier handling of lockout device 10 and easier insertion of a subsequently applied locking device 46 as shown in FIG. 10, however the particular shape of integral extension 26 is not critical to successful implementation of the device of the present invention. Integral extension 26 includes at least one and preferably two sets of opposing access ports 48 and 50. As described hereinafter, these ports will permit insertion of locking device 46 through the assembled and installed device of the present invention.

Inserted into recess 34 of block 20 is nose 16. Nose 16 is of the same general shape as recess 34 so that twisting of block 20 relative to nose 16 will not result in disengagement of nose 16 from block 20. As a further deterrent to disengagement of block 20 and nose 16, an adhesive layer 18 may optionally, and preferably is, applied between block 20 and nose 16. Adhesive mau optionally be applied between nose member rear face 13 and nose face 64.

Nose member 16 includes blade apertures 52 for receiving and engaging the recessed male power and ground blades 54 of the electrical connector 56, of equipment 60 which is being locked out. For ease of manufacture, blade apertures 52 may penetrate the entire thickness of nose 16, but they only need to be adequately deep as to receive male power and ground blades 54 without limiting proper engagement of nose 16 with recess 58 in electrical connector 56. Nose 16 also includes passage 62 for admission of threaded member 14 in the assembled configuration described below. In the fully assembled configuration, passage 62 is concentric with hole 32.

Nose 16 is manufactured from an elastomeric material which readily deforms upon application of pressure by tightening of thumb screw assembly 22 as described hereinafter. Elastomeric materials such as polyurethane having a durometer of about 40A have been found to produce satisfactory results, however butyl rubber and other similar elastomeric materials well known to those skilled in this art will be equally useful.

Abutting front face 64 of nose 16 is face-plate 12 having threaded member 14 attached thereto or passing therethrough. Face-plate 12 is preferably constructed of 12 gauge steel or rigid plastic. While it is preferred that threaded member 14 be affixed to face-plate 12 by welding, gluing or otherwise, it may simply be inserted through an aperture in face-plate 12 such that in the finally assembled configuration, it is not easily removable. In one preferred embodiment, threaded member 14 having a captive head, can be attached to the steel face plate with a press. What is critical is that threaded member 14 be attached to face-plate 12 such that it cannot be easily extracted from the assembled and locked device, regardless of the mode of attachment of threaded member 14 to face-plate 12.

Face-plate 12 also includes blade apertures 66 for receipt of connector blades 54. Apertures 66 must of course register with blade apertures 52 in nose member 16 in the final assembly. Apertures 66 are slightly larger than apertures 52 of nose 16 to limit metallic contact with power blades 54.

Figure 5:
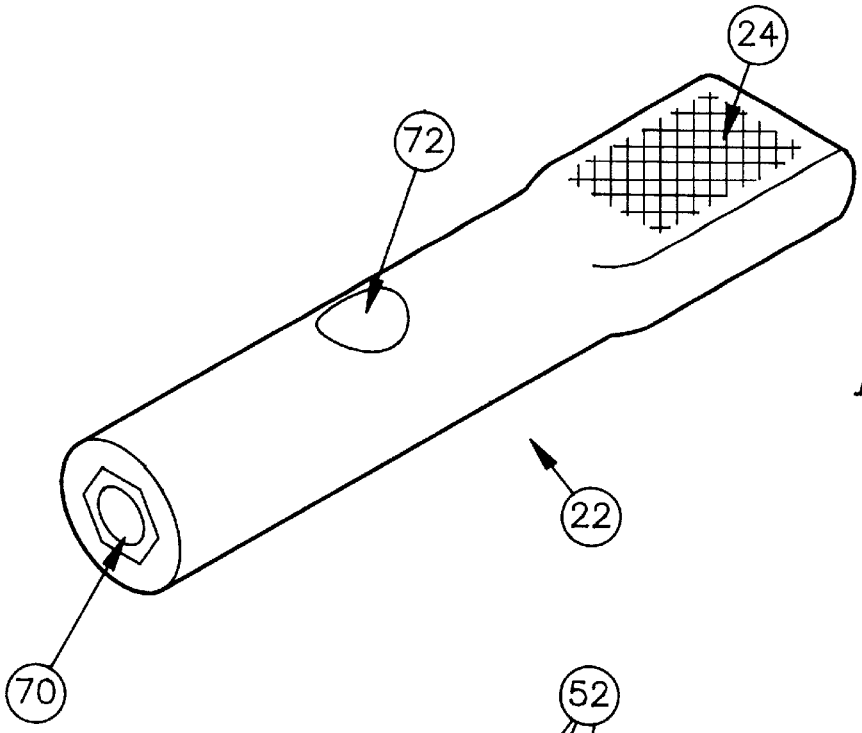
FIG. 5 is a perspective view of the thumbscrew assembly of the lockout device of the present invention.

The final element of the lockout device of the present invention is thumb screw assembly 22. Thumb screw assembly 22 is generally cylindrical in shape and of an external dimension as to fit through opening 44 and into passageway 28 of block 20. One end 68 of thumb screw assembly 22 is flattened, molded or otherwise configured for ease of grasping with the fingers or hands, i.e. without tools. The interior of thumb screw assembly 22 includes thread means 70 designed to engage threaded member 14 in the assembled configuration. Thread means 70 may include total internal threading of thumb screw assembly 22 or as shown in FIGS. 5 and 8 simply the incorporation of a nut 70 into the end of the interior of thumb screw assembly 22. Whatever the threaded means utilized, it must again be such that it firmly engages threaded member 14 in such a fashion that it cannot be easily separated from the other elements of the lockout device. Many such modes of attachment will be readily apparent to the skilled artisan.

Thumb screw assembly 22 also includes a locking aperture 72 therethrough. Locking aperture 72 is of the same general size and configuration as apertures 48 and 52 of integral extension 26 and designed to align therewith for the admission of locking device 46 once all of the elements are appropriately assembled as described below.

Figure 9:
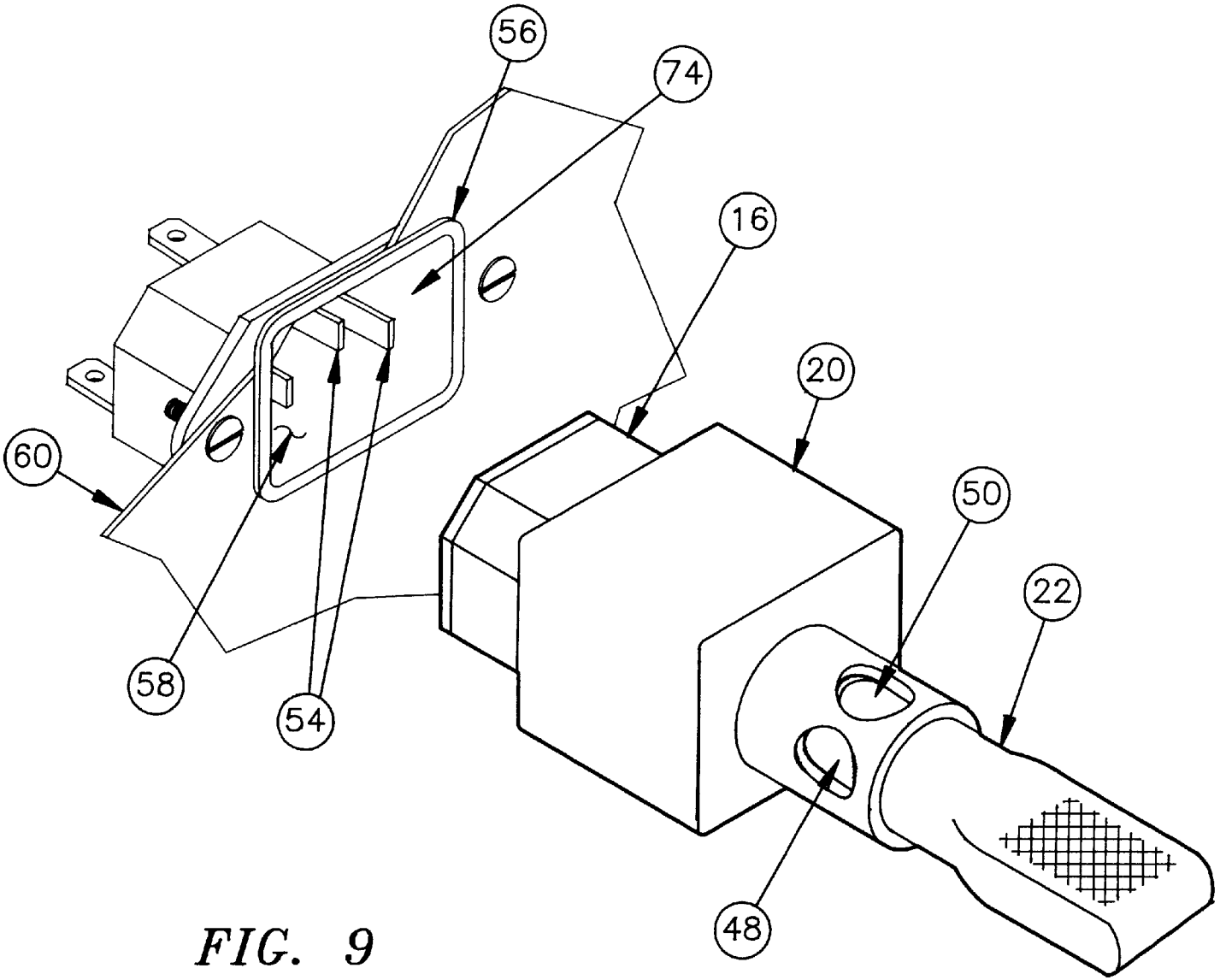
FIG. 9 is a perspective view of the lockout device of the present invention as it is about to be inserted into a male power blade containing recess in a piece of electrical equipment.

Application of the lockout device 10 of the present invention is shown in FIGS. 9 and 10. Lockout device 10 is assembled as shown in FIG. 8. Threaded member 14 with face-plate 12 attached thereto is inserted through aperture 62 in nose member 16 and power blade apertures 52 and 66 aligned. This two piece assembly is then inserted into recess 34 in front face 38 of block 20. Upon insertion, threaded member 14 enters hole 32 and extends into passage 28 sufficiently to engage subsequently inserted thumb screw assembly 22. Optional adhesive layer 18 is applied between nose member 16 and recess 34 prior to insertion of nose member 16 into recess 34. Thumb screw assembly 22 is then inserted through opening 44 in integral extension 26 of block 20 so that threaded means 70 engages threaded member 14. Face-plate 12 with abutting nose member 16 are then inserted into recess 58 in electrical connector 56 of electrical equipment 60 so that aligned power blade apertures 66 and 52 accomodate blades 54. As thumb screw 22 is rotated clockwise, face plate 12is drawn toward thumb screw assembly 22 with threaded member 14, nose member 16 is compressed longitudinally between the rear face 13 of face plate 12 and recess 34 of front face 38 of block 20. With this compression, nose member 16 is forced to expand laterally or circumferentially to place it securely in contact with inner surface 74 of electrical connector recess 58. Thumb screw assembly 22 is then tightened firmly with the fingers and one pair of apertures 50 or 48 aligned with locking aperture 72 in thumb screw assembly 22. Tightening of thumb screw 22 should be performed until lockout device 10 cannot be pulled from recess 58. Locking device 46, which may be a simple padlock or a locking cable, is them inserted through locking aperture 72 and locked. In this configuration as shown in FIG. 10, thumb screw 22 cannot be turned to release the compressive pressure restraining nose member 16 in recess 58, thus making it impossible for someone intentionally or accidentally to attach a power cord to the electrical equipment.

In the case where locking device 46 is a locking cable, the cable can be extended about some fixed or large relatively immovable object such as a table to inhibit removal of the electrical device to which the lockout device is attached. A cable assembly can also be used to string several devices together, therefore requiring only a single padlock to immobilize several devices.

Those skilled in the art having the benefit of the teachings of the present invention as described herein may effect numerous modifications thereto which are intended to be within the scope of the appended claims. For example, although block 20 is shown to be substantially rectangular in shape, it may take any suitable configuration so long as the various elements may interact as described to perform the intended function. Similarly, although integral extension 26 is shown as cylindrical, it could just as suitably have a rectangular exterior, and thumb screw assembly 22 could have a rectangular gripping end as opposed to a flattened gripping end.

Thus, it is intended that the description of the preferred embodiment of this invention is illustrative only. Other embodiments of the invention are within the scope of this invention which is intended to be limited only by the scope of the appended claims.

What is claimed is:

1. An electrical lockout device comprising:

a face-plate having a threaded member attached thereto and including power blade apertures suitable for engaging the power blades of a recessed electrical connector;

an elastomeric nose member abutting said face-plate having power blades apertures which register with the power blade apertures in said face-plate;

a block having forward and rear faces, a recess in said forward face, and an extension extending from said rear face; and a thumb screw designed for insertion into said extension with at least a portion of said thumb screw extending beyond said extension upon insertion therein;

said forward face of said block in non-rotary engagement to said threaded member;

a passage extending through said block including said extension designed to receive said thumb screw;

a threaded end on said thumb screw designed to engage said threaded member;

at least one locking aperture in said thumb screw; and said locking aperture in said thumb screw designed to register with at least one aperture in said integral extension when said thumb screw is tightened upon said threaded member.

2. The electrical lockout device of claim 1 further including an adhesive layer between the surface of said nose member abutting said block and said block.

3. The electrical lockout device of claim 1 wherein said integral extension is of a cylindrical shape.

4. The electrical lockout device of claim 1 wherein that portion of said thumb screw that extends beyond said extension is flattened to permit easy grasping.

5. The electrical lockout device of claim 1 wherein the portion of said thumb screw that extends beyond said integral extension is of a rectangular configuration.

6. The electrical lockout device of claim 1 wherein said portion of said thumb screw that extends beyond said integral extension is of a rectangular shape.

7. The electrical lockout device of claim 1 wherein said face-plate is constructed of a rigid plastic or metal.

* * * * *

UNITED STATES PATENT AND TRADEMARK OFFICE

CERTIFICATE OF CORRECTION

PATENT NO. : 5,964,598
DATED : October 12, 1999
INVENTOR(S) : Rick Gonzales

It is certified that error appears in the above-identified patent and that said Letters Patent is hereby corrected as shown below:

Column 1,
Line 6, change "DE-AC05-84ER" to -- DE-AC05-84ER40150 --

Signed and Sealed this

Eighteenth Day of March, 2003

JAMES E. ROGAN
*Director of the United States Patent and Trademark Office*